US009026015B2

(12) United States Patent
Juri et al.

(10) Patent No.: US 9,026,015 B2
(45) Date of Patent: May 5, 2015

(54) DEVELOPING ROLLER, AND DEVELOPING DEVICE, PROCESS CARTRIDGE AND IMAGE FORMING METHOD AND APPARATUS USING THE DEVELOPING ROLLER

(71) Applicants: Keiichiro Juri, Hyogo (JP); Hideaki Yasunaga, Osaka (JP); Chiyoshi Nozaki, Shizuoka (JP)

(72) Inventors: Keiichiro Juri, Hyogo (JP); Hideaki Yasunaga, Osaka (JP); Chiyoshi Nozaki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/160,652

(22) Filed: Jan. 22, 2014

(65) Prior Publication Data

US 2014/0212184 A1 Jul. 31, 2014

(30) Foreign Application Priority Data

Jan. 30, 2013 (JP) ..... 2013-016197

(51) Int. Cl.
*G03G 15/08* (2006.01)

(52) U.S. Cl.
CPC ..... *G03G 15/0818* (2013.01)

(58) Field of Classification Search
CPC ..... G03G 15/0818
USPC ..... 399/286
See application file for complete search history.

(56) References Cited

U.S. PATENT DOCUMENTS

2006/0204882 A1 9/2006 Nozaki et al.
2006/0210902 A1 9/2006 Nakamura et al.
2006/0275686 A1 12/2006 Kadota et al.
2007/0059625 A1 3/2007 Yamamoto et al.
2007/0122729 A1 5/2007 Katoh et al.
2007/0148568 A1 6/2007 Kadota et al.
2007/0166635 A1 7/2007 Yamamoto et al.
2007/0190442 A1 8/2007 Nakamura et al.
2007/0190443 A1 8/2007 Hagi et al.
2007/0207399 A1 9/2007 Kadota et al.
2007/0212630 A1 9/2007 Yasunaga et al.
2007/0217842 A1 9/2007 Kato et al.
2007/0218384 A1 9/2007 Matsumoto et al.
2007/0218388 A1 9/2007 Kurose et al.
2007/0218390 A1 9/2007 Nozaki et al.
2007/0218393 A1 9/2007 Nozaki et al.
2007/0238042 A1 10/2007 Yasunaga et al.
2008/0032223 A1 2/2008 Yamamoto et al.

(Continued)

FOREIGN PATENT DOCUMENTS

JP 4-313782 11/1992
JP 2000-026719 1/2000

(Continued)

*Primary Examiner* — David Gray
*Assistant Examiner* — Laura Roth
(74) *Attorney, Agent, or Firm* — Cooper & Dunham LLP

(57) ABSTRACT

A developing roller to bear toner thereon is provided. The developing roller includes a cylindrical electroconductive substrate; an electroconductive elastic layer located on a peripheral surface of the cylindrical electroconductive substrate; and a toner bearing layer located on a peripheral surface of the electroconductive elastic layer. The toner bearing layer includes a polyurethane resin, which is a reaction product of at least an isocyanate compound having an isocyanurate structure and a polyol at a NCO/OH molar ratio of from 90 to 110. The toner bearing layer has a water contact angle of from 135° to 155°, and a static friction coefficient of from 0.10 to 0.15.

10 Claims, 4 Drawing Sheets

(56) References Cited

U.S. PATENT DOCUMENTS

| | | | |
|---|---|---|---|
| 2008/0038656 | A1 | 2/2008 | Yasunaga et al. |
| 2008/0063957 | A1 | 3/2008 | Murakami et al. |
| 2008/0069598 | A1 | 3/2008 | Murakami et al. |
| 2008/0069605 | A1 | 3/2008 | Fuwa et al. |
| 2008/0069608 | A1 | 3/2008 | Katoh et al. |
| 2008/0069617 | A1 | 3/2008 | Matsumoto et al. |
| 2008/0070149 | A1 | 3/2008 | Kato et al. |
| 2008/0076054 | A1 | 3/2008 | Nozaki et al. |
| 2008/0081273 | A1 | 4/2008 | Murakami et al. |
| 2008/0096119 | A1 | 4/2008 | Yamamoto et al. |
| 2008/0124635 | A1 | 5/2008 | Nakamura et al. |
| 2008/0131797 | A1 | 6/2008 | Ishikawa et al. |
| 2008/0153018 | A1 | 6/2008 | Mikuriya et al. |
| 2008/0159777 | A1 | 7/2008 | Fuwa et al. |
| 2008/0175630 | A1 | 7/2008 | Yasunaga et al. |
| 2008/0176159 | A1 | 7/2008 | Matsumoto et al. |
| 2008/0199234 | A1 | 8/2008 | Hagi et al. |
| 2008/0220357 | A1 | 9/2008 | Nozaki et al. |
| 2008/0226356 | A1 | 9/2008 | Yasunaga et al. |
| 2008/0227001 | A1 | 9/2008 | Kadota et al. |
| 2008/0227009 | A1 | 9/2008 | Fuwa et al. |
| 2008/0227013 | A1 | 9/2008 | Kadota et al. |
| 2008/0227016 | A1 | 9/2008 | Nozaki et al. |
| 2008/0232857 | A1 | 9/2008 | Matsumoto et al. |
| 2008/0233497 | A1 | 9/2008 | Yamamoto et al. |
| 2008/0233506 | A1 | 9/2008 | Hagi et al. |
| 2008/0233510 | A1 | 9/2008 | Nozaki et al. |
| 2008/0233511 | A1 | 9/2008 | Ishikawa et al. |
| 2008/0279591 | A1 | 11/2008 | Yasunaga et al. |
| 2008/0304875 | A1 | 12/2008 | Katoh et al. |
| 2009/0017391 | A1 | 1/2009 | Yamamoto et al. |
| 2009/0041511 | A1 | 2/2009 | Fuwa et al. |
| 2009/0052952 | A1 | 2/2009 | Katoh et al. |
| 2009/0117481 | A1 | 5/2009 | Yasunaga et al. |
| 2009/0169270 | A1 | 7/2009 | Fuwa et al. |
| 2009/0186291 | A1 | 7/2009 | Mikuriya et al. |
| 2009/0220879 | A1 | 9/2009 | Matsumoto et al. |
| 2009/0232542 | A1 | 9/2009 | Yamamoto et al. |
| 2009/0233199 | A1 | 9/2009 | Nozaki et al. |
| 2009/0297975 | A1 | 12/2009 | Ishikawa et al. |
| 2010/0009282 | A1 | 1/2010 | Katoh et al. |
| 2010/0055603 | A1 | 3/2010 | Nozaki et al. |
| 2010/0150609 | A1 | 6/2010 | Nozaki et al. |
| 2010/0167196 | A1 | 7/2010 | Hagi et al. |
| 2010/0227265 | A1 | 9/2010 | Matsumoto et al. |
| 2011/0045401 | A1 | 2/2011 | Murakami et al. |
| 2011/0217644 | A1 | 9/2011 | Yamamoto et al. |
| 2011/0243616 | A1 | 10/2011 | Nakagawa et al. |
| 2011/0249994 | A1 | 10/2011 | Matsushita et al. |
| 2012/0237270 | A1 | 9/2012 | Juri et al. |
| 2013/0058685 | A1 | 3/2013 | Juri et al. |

FOREIGN PATENT DOCUMENTS

| | | |
|---|---|---|
| JP | 2004-198710 | 7/2004 |
| JP | 2006-023650 | 1/2006 |
| JP | 2008-158031 | 7/2008 |
| JP | 2011-215467 | 10/2011 |

DEVELOPING ROLLER, AND DEVELOPING DEVICE, PROCESS CARTRIDGE AND IMAGE FORMING METHOD AND APPARATUS USING THE DEVELOPING ROLLER

CROSS-REFERENCE TO RELATED APPLICATIONS

This patent application is based on and claims priority pursuant to 35 U.S.C. §119 to Japanese Patent Application No. 2013-016197 filed on Jan. 30, 2013 in the Japan Patent Office, the entire disclosure of which is hereby incorporated by reference herein.

TECHNICAL FIELD

This disclosure relates to a developing roller. In addition, this disclosure relates to a developing device, a process cartridge, an image forming apparatus, and an image forming method using the developing roller.

BACKGROUND

Recently, a one-component developing method is typically used for small laser printers. From the viewpoints of costs (cost per page) and environmental burden of such small laser printers, a need exists for a toner (one-component developer) having low temperature fixability. In addition, a need exist for a developing roller, which has a low cost and a long life and which can be used for high speed development.

Conventional developing rollers tend to easily cause problems such that a film of components (such as external additives) of toner is formed on the surface of the developing rollers, thereby deteriorating the charging ability of the developing rollers or deteriorating reproducibility of solid toner images (this problem is hereinafter referred to as a toner filming problem); and the surface of the developing rollers is abraded due to friction between the toner and the developing rollers (this problem is hereinafter referred to as a roller abrasion problem). It is considered that these problems are prominently caused if a toner having low temperature fixability is used and the developing rollers are used for high speed development over a long period of time.

In attempting to prevent formation of a film of toner components and to improve image quality under high temperature and high humidity conditions, JP-2011-215467-A discloses a developing roller having a toner bearing layer including a fluorine-containing urethane resin so that the developing roller has good releasability from toner. However, when low temperature fixable toner is used in combination with such a developing roller, it is hard to prevent occurrence of the toner filming problem and the roller abrasion problem mentioned above.

SUMMARY

As an aspect of this disclosure, a developing roller is provided which includes a cylindrical electroconductive substrate, an electroconductive elastic layer located on the peripheral surface of the cylindrical electroconductive substrate, and a developer bearing layer (hereinafter referred to as a toner bearing member) located on the peripheral surface of the electroconductive elastic layer. The toner bearing layer includes a polyurethane resin which is a reaction product of at least an isocyanate compound having an isocyanurate structure and a polyol at a NCO/OH molar ratio of from 90 to 110.

The toner bearing layer has a water contact angle of from 135° to 155°, and a static friction coefficient of from 0.10 to 0.15.

As another aspect of this disclosure, a developing device is provided which includes the above-mentioned developing roller to bear a developer including a toner on a surface thereof to supply the developer to a latent image bearing member; a developer container to contain the developer; a developer supplying member to supply the developer in the developer container to the surface of the developing roller; and a developer regulating member to form a layer of the developer on the surface of the developing roller.

As another aspect of this disclosure, a process cartridge is provided which includes a latent image bearing member to bear an electrostatic latent image on a surface thereof; and the above-mentioned developing device to develop the electrostatic latent image on the surface of the latent image bearing member with a developer including a toner to form a toner image on the surface of the latent image bearing member. The latent image bearing member and the developing device are integrated as a unit.

As another aspect of this disclosure, an image forming apparatus is provided which includes a latent image bearing member to bear an electrostatic latent image on a surface thereof; a charger to charge the surface of the latent image bearing member; an irradiator to irradiate the charged surface of the latent image bearing member with light based on image data to form the electrostatic latent image on the surface of the latent image bearing member; the above-mentioned developing device to develop the electrostatic latent image with a developer including a toner to form a toner image on the surface of the latent image bearing member; a transferring device to transfer the toner image onto a recording medium; and a fixing device to fix the toner image to the recording medium.

As another aspect of this disclosure, an image forming method is provided which includes charging a surface of a latent image bearing member; irradiating the charged surface of the latent image bearing member with light based on image data to form an electrostatic latent image on the surface of the latent image bearing member; forming a developer layer with a predetermined thickness on the above-mentioned developing roller using a developer regulating member; developing the electrostatic latent image with the developer layer on the developing roller to form a toner image on the surface of the latent image bearing member; transferring the toner image onto a recording medium; and fixing the toner image to the recording medium.

The aforementioned and other aspects, features and advantages will become apparent upon consideration of the following description of the preferred embodiments taken in conjunction with the accompanying drawings.

DETAILED DESCRIPTION

Figure 1:
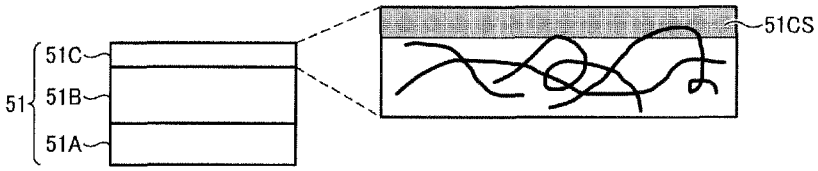
FIG. 1 is a schematic cross-sectional view illustrating a developing roller according to an embodiment.

The object of this disclosure is to provide a developing roller which hardly causes the toner filming problem and the roller abrasion problem mentioned above even when low temperature fixable toner is used and high speed development is performed over a long period of time.

The developing roller of this disclosure includes an electroconductive cylinder, an electroconductive elastic layer located on the peripheral surface of the electroconductive cylinder, and a developer bearing layer (hereinafter referred to as a toner bearing layer) located on the peripheral surface of the electroconductive elastic layer. The toner bearing layer includes a polyurethane resin which is a reaction product of an isocyanate compound having an isocyanurate structure and a polyol at a NCO/OH molar ratio of from 90 to 110. The toner bearing layer has a water contact angle of from 135° to 155', and a static friction coefficient of from 0.10 to 0.15.

The polyurethane resin is preferably a reaction product of a polyisocyanate prepolymer having an isocyanurate structure, a polyol, and at least one of a compound having a fluorine-containing group or a silicone-based functional group, and a compound having a long alkyl group in a side chain thereof.

The compound having a fluorine-containing group or a silicone-based functional group is preferably a compound selected from fluoroethylene vinyl ether copolymers, carboxylic acids having a perfluoroalkyl group, alcohols having a perfluoroalkyl group, amines having a perfluoroalkyl group, and silane coupling agents having a perfluoroalkyl group.

The compound having a long alkyl group in a side chain thereof is preferably a compound selected from alcohols having a long alkyl group, and amines having a long alkyl group.

The polyisocyanate prepolymer preferably includes at least one of isocyanurate of hexamethylene diisocyanate (HDI) and isocyanurate of tolylene diisocyanate (TDI).

Alternatively, the polyurethane resin may be a reaction product of a polyisocyanate prepolymer having an isocyanurate structure, and a polyol having a fluorine-containing group, a silicone-based functional group, or a long alkyl group, which is included in a side chain thereof.

The developing device of this disclosure includes the above-mentioned developing roller to bear a developer including a toner on a surface thereof to supply the developer to a latent image bearing member; a developer container to contain the developer; a developer supplying member to supply the developer in the developer container to the surface of the developing roller; and a developer regulating member to form a layer of the developer on the surface of the developing roller.

The process cartridge of this disclosure includes a latent image bearing member to bear an electrostatic latent image on a surface thereof; and the above-mentioned developing device to develop the electrostatic latent image on the surface of the latent image bearing member with a developer including a toner to form a toner image on the surface of the latent image bearing member. The latent image bearing member and the developing device are integrated as a unit.

The image forming apparatus of this disclosure includes a latent image bearing member to bear an electrostatic latent image on a surface thereof; a charger to charge the surface of the latent image bearing member; an irradiator to irradiate the charged surface of the latent image bearing member with light based on image data to form the electrostatic latent image on the surface of the latent image bearing member; the above-mentioned developing device to develop the electrostatic latent image with a developer including a toner to form a toner image on the surface of the latent image bearing member; a transferring device to transfer the toner image onto a recording medium; and a fixing device to fix the toner image to the recording medium.

The image forming method of this disclosure includes charging a surface of a latent image bearing member; irradiating the charged surface of the latent image bearing member with light based on image data to form an electrostatic latent image on the surface of the latent image bearing member; forming a developer layer with a predetermined thickness on the above-mentioned developing roller using a developer regulating member; developing the electrostatic latent image with the developer layer on the developing roller to form a toner image on the surface of the latent image bearing member; transferring the toner image onto a recording medium; and fixing the toner image to the recording medium.

The toner bearing layer of the developing roller of this disclosure includes a polyurethane resin which is a reaction product of at least an isocyanate compound having an isocyanurate structure and a polyol at a NCO/OH molar ratio of from 90 to 110. In this regard, a proper polyurethane resin is selected so that the toner bearing layer has a water contact angle of from 135° to 155°, and a static friction coefficient of from 0.10 to 0.15. The developing roller having such a toner bearing layer has a good releasability and a low frictional property. Therefore, when the developing roller is rubbed with toner, the toner is not easily adhered to the surface of the developing roller, and the surface of the developing roller becomes slippery. Accordingly, even when low temperature fixable toner is used, occurrence of the toner filming problem can be prevented. In addition, since the surface of the developing roller is slippery, occurrence of the roller abrasion problem can be prevented.

The water contact angle of the toner bearing layer is controlled so as to be from 135° to 155°. When the water contact angle is greater than 155°, occurrence of the toner filming problem can be prevented, but the adhesive force between the developing roller and the toner becomes too low, and therefore the toner is not satisfactorily charged frictionally by the developing roller, thereby easily causing a background development problem such that the background of an image is soiled with the toner. In contrast, when the water contact angle is less than 135°, the releasability of the toner bearing layer deteriorates, thereby increasing the adhesive force between the developing roller and the toner. Therefore, when the developing roller is used over a long period of time, the toner filming problem tends to be easily caused and reproducibility of a solid image tends to deteriorate (i.e., a solid image having a low image density portion as illustrated in FIG. 4B is formed).

The static friction coefficient of the toner bearing layer is controlled so as to be from 0.10 to 0.15. When the static friction coefficient is less than 0.10, the toner scraping property of the developing roller tends to deteriorate, thereby deteriorating the toner feeding ability of the developing roller. In contrast, when the static friction coefficient is greater than 0.15, the surface of the developing roller tends to be easily abraded due to friction between the developing roller and an edge member to form the edge of the toner layer on the developing roller. When a portion of the surface of the developing roller is seriously abraded, the toner leaks from the portion, and the toner is adhered to an image or scatters around the developing device. Alternatively, when the static friction coefficient is greater than 0.15, a problem in that the toner is melted on the surface of the developing roller due to heat caused by friction between the developing roller and the edge member.

The polyurethane resin included in the toner bearing layer is not particularly limited as long as the polyurethane resin has an isocyanurate structure, and has the water contact angle and the static friction coefficient mentioned above. However, a reaction products of a polyisocyanate prepolymer capable of forming an isocyanurate, and at least one of a compound having a fluorine-containing group or a silicone-based functional group and a compound having a long alkyl group in a side chain thereof is preferable. By using such a reaction product, a fluorine-containing functional group or a silicone-based functional group is eccentrically present so as to be in a surface portion of the toner bearing layer as illustrated by a reference numeral 51CS in FIG. 1, thereby producing the effect of the developing roller of this disclosure.

Polyisocyanates having two or more isocyanate groups (NCO) are used as the polyisocyanate prepolymer capable of forming an isocyanurate.

The polyisocyanate is not particularly limited, and a proper polyisocyanate is selected depending on the intended use of the developing roller. Specific examples of such a polyisocyanate include isocyanurates of methylenephenyl diisocyanate (MDI), tolylene diisocyanate (TDI), xylylene diisocyanate (XDI), naphtyhlene-1,5-diisocyanate (NDI), tetramethylxylene diisocyanate (TMXDI), isophorone diisocyanate (IPDI), hydrogenated xylylene diisocyanate (H6XDI), dicyclohexymethane diisocyanate (H12MDI), hexamethylene diisocyanate (HDI), dimmer acid diisocyanate (DDI), norbornene diisocyanate (NBDI), and trimethylhexamethylene diisocyanate (TMDI). Specific examples of the marketed products thereof include D170N (isocyanurate of hexamethylene diisocyanate) from Mitsui Chemicals, Inc., and D262 (isocyanurate of tolylene diisocyanate) from Mitsui Chemicals, Inc.

Suitable materials for use as the compound having a fluorine-containing group or a silicone-based functional group include copolymers of perfluoroethylene vinyl ether, carboxylic acids having a perfluoroalkyl group, alcohols having a perfluoroalkyl group, amines having a perfluoroalkyl group, and silane coupling agents having a perfluoroalkyl group.

Suitable materials for use as the compound having a long alkyl group in a side chain thereof include polyols having a long alkyl group, alcohols having a long alkyl group, and amines having a long alkyl group.

Next, the mechanism for producing the effect of the developing roller of this disclosure will be described by reference to FIGS. 1-4.

FIG. 1 is a schematic cross-sectional view illustrating an example of the developing roller of this disclosure, and includes an enlarged view of the toner bearing layer. Referring to FIG. 1, a developing roller 51 includes a cylindrical electroconductive substrate 51A, an electroconductive elastic layer 51B located on the cylindrical electroconductive substrate 51A, and a toner bearing layer 51C located on the electroconductive elastic layer 51B.

The toner bearing layer 51C illustrated in FIG. 1 includes a polyurethane resin prepared by using a fluorine-containing polyol or a silicone-based polyol. As illustrated in FIG. 1, a fluorine-containing polyol component or a silicone-based polyol component, which has low surface energy, is eccentrically located in a surface portion 5 ICS of the toner bearing layer 51C, thereby making it possible to decrease the adhesive force between the developing roller and toner, resulting in prevention of occurrence of the toner filming problem. Further, since the surface of the toner bearing layer 51C becomes slippery, abrasion of the surface of the developing roller 51 can be prevented even when the developing roller is rubbed with another member such as the edge member.

The shape, structure, size and constitutional material of the cylindrical electroconductive substrate 51A are not particularly limited, and are determined depending on the intended use of the developing roller. With respect to the shape, both of solid cylinders having no hollow and hollow cylinders can be used. With respect to the structure, both of a single-layered structure and a multi-layered structure can be available. The size of the cylindrical electroconductive substrate 51A is determined depending on the size of the developing roller 51. The cylindrical electroconductive substrate 51A preferably has a volume resistivity of not greater than $10^{10}$ Ω·cm.

Specific examples of the materials of the cylindrical electroconductive substrate 51A include the following.

(1) Cylinders of a metal such as iron, aluminum, stainless steel, and brass;

(2) Cylinders including a cylinder of a resin (such as thermoplastic resins and thermosetting resins) covered with a metal film, which is formed by plating;

(3) Cylinders including a cylinder of a resin (such as thermoplastic resins and thermosetting resins) covered with a metal film, which is formed by vapor deposition; and (4) Cylinders prepared by molding a resin composition including a resin component such as thermoplastic resins and thermosetting resins, and an electroconductive agent such as powders of carbon black and metals.

The electroconductive elastic layer 51B includes an elastic material and an electroconductive agent, and optionally includes other components. The electroconductive elastic layer 51B preferably has a volume resistivity of not greater than $10^{10}$ Ω·cm.

The elastic material is not particularly limited, and is determined depending on the intended use of the developing roller. Specific examples of the elastic material include rubbers and elastomers such as silicone rubbers, ethylene-propylene-butadiene rubbers, polyurethane rubbers, chloroprene rubbers, natural rubbers, butyl rubbers, polyisoprene rubbers, polybutadiene rubbers, styrene-butadiene rubbers, nitrile rubbers, ethylene-propylene rubbers, acrylic rubbers, and epichlorohydrin rubbers. These can be used alone or in combination. Among these, epichlorohydrin rubbers are preferable because of having proper hardness.

The electroconductive agent included in the electroconductive elastic layer 51B is not particularly limited, and a proper electroconductive agent is selected depending on the intended use of the developing roller. For example, ionic electroconductive agents and electronic electroconductive agents can be used. Specific examples of the ionic electroconductive agents include ammonium (e.g., tetraethylammonium, tetrabutylammonium, dodecyltrimethylammonium, lauryltrimethylammonium, hexadecyltrimethylammonium, octadecyltrimethylammonium, stearyltrimethylammonium, modified fatty acid dimethylethylammonium, and lauryltrimethylammonium chloride) salts of acids (e.g., perchloric acid, chloric acid, bromic acid, iodic acid, fluoroboric acid, sulfuric acid, ethylsulfuric acid, carboxylic acid, and sulfonic acid); and alkali metal or alkali earth metal (e.g., Li, Na, K, Ca, and Mg) salts of acids (e.g., perchloric acid, chloric acid, bromic acid, iodic acid, fluoroboric acid, sulfuric acid, ethylsulfuric acid, carboxylic acid, and sulfonic acid).

Specific examples of the electronic electroconductive agents include electroconductive carbon blacks such as KETJEN BLACK and acetylene black; carbon blacks for rubbers such as SAF (Surface Abrasion Furnace), ISAF (Intermediate Surface Abrasion Furnace), HAF (High Abrasion Furnace), FEF (Fast Extruding Furnace), GPF (General Purpose Furnace), SRF (Semi Reinforcing Furnace), FT (Fine Thermal) and MT (Medium Thermal); carbon blacks for ink subjected to an oxidation treatment; pyrolytic carbon blacks; graphite such as natural graphite and artificial graphite; electroconductive metal oxides such as tin oxide, titanium oxide and zinc oxide; and metals such as copper, silver and germanium. These can be used alone or in combination.

The added amount of such an ionic electroconductive agent is preferably from 0.01 to 5 parts by weight, and more preferably from 0.05 to 2 parts, based on 100 parts by weight of the elastic material included in the electroconductive elastic layer 51B. The added amount of such an electronic electroconductive agent is preferably from 1 to 50 parts by weight, and more preferably from 5 to 40 parts, based on 100 parts by weight of the elastic material included in the electroconductive elastic layer 51B.

Other components such as softening agents, vulcanizing agents, process aids, anti-aging agents, fillers, and stiffeners can be used for the electroconductive elastic layer 51B.

The average thickness of the electroconductive elastic layer 51B is not particularly limited, but is preferably from 1 to 10 mm.

Figure 2:
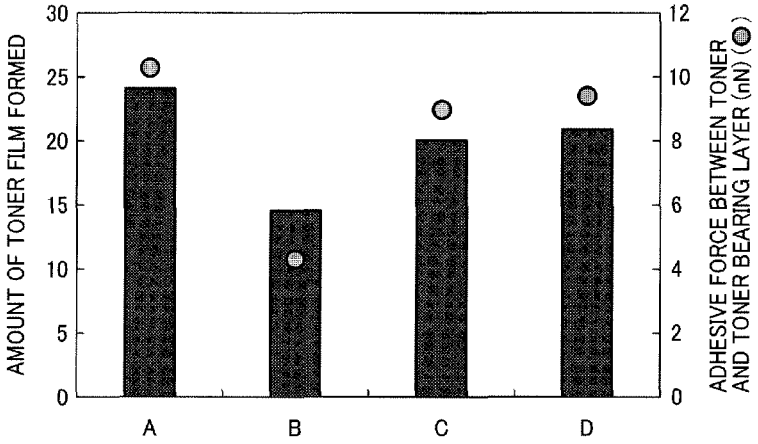
FIG. 2 is a schematic view illustrating a relationship between the amount of a film of toner formed on toner bearing layers and the adhesive force between the toner bearing layers and the toner.

FIG. 2 is a schematic view illustrating a relationship between the amount of a film of toner formed on toner bearing layers (samples A-D) and the adhesive force between the toner bearing layers and the toner. In FIG. 2, the adhesive force is represented by a circle mark (●), and the amount of toner film is represented by a bar (■). In this regard, the amount of toner film is determined by FT-IR (Fourier Transform Infrared Spectroscopy) and therefore has no units.

Each of the samples A-D was prepared by coating a coating liquid on a polyethylene terephthalate (PET) film. The sample A was prepared by using the toner bearing layer coating liquid used for Comparative Example 1 below. The sample B was prepared by using the toner bearing layer coating liquid used for Examples 1 and 2 below, wherein the NCO/OH molar ratio is 100. The sample C was prepared by using the toner bearing layer coating liquid used for Comparative Example 3 below. The sample D was prepared by using the toner bearing layer coating liquid used for Comparative Example 2 below.

It can be understood from FIG. 2 that the adhesive force is correlated with the amount of toner film in such a manner that the lower the adhesive force, the smaller the amount of toner film formed on the toner bearing layer. The present inventors discover that the adhesive force is also correlated with the water contact angle of the toner bearing layer. Therefore, in this application, the water contact angle is used as a substitute for the adhesive force. Namely, when the water contact angle increases (i.e., the surface energy of the toner bearing layer increases), the adhesive force decreases, and when the water contact angle decreases (i.e., the surface energy of the toner bearing layer decreases), the adhesive force increases.

Figure 3:
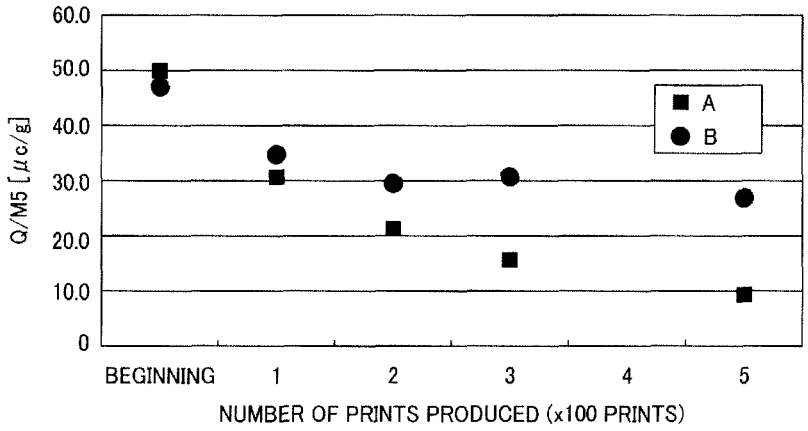
FIG. 3 is a schematic view illustrating change of charge quantity of toner when the number of toner images formed by each of two different developing rollers increases.

FIG. 3 is a schematic view illustrating change of charge quantity (Q/M) of a toner when the number of toner images formed by each of two different developing rollers A and B increases. The developing roller A is the developing roller prepared in Comparative Example 1 below by using the sample A mentioned above, and the developing roller B is the developing roller prepared in Example 1 below by using the sample B mentioned above.

It can be understood from FIG. 3 that when using the developing roller A, on which a relatively large amount of toner film is formed as the number of prints increases, the decrease ratio of the charge quantity (Q/M) of the toner is relatively large, and when using the developing roller B, on which a relatively small amount of toner film is formed as the number of prints increases, the decrease ratio of the charge quantity (Q/M) of the toner is relatively small. This is because the NCO/OH molar ratio, which contributes to charging of toner, is much greater (90 to 110 times) in the toner bearing layer of the developing roller B than that in the toner bearing layer of the developing roller A, and therefore the developing roller B has better charging ability.

The Arithmetic Mean Deviation of the Profile (Ra) and the ten-point mean roughness (Rz) of the developing rollers A and B before and after a long repeated use are shown in Table 1 below.

TABLE 1

| | | Developing roller A | Developing roller B |
|---|---|---|---|
| Ra | Beginning (Before long repeated use) | 1.00 | 0.89 |
| | After ong repeated use | 0.54 | 0.71 |
| Rz | Beginning (Before long repeated use) | 13.75 | 12.44 |
| | After long repeated use | 8.51 | 8.70 |

Since a large amount of toner film is formed on the developing roller A, the developing roller A has a small Arithmetic Mean Deviation of the Profile (Ra) after long repeated use. In contrast, since the amount of toner film formed on the developing roller B is relatively small even after long repeated use, change in the Arithmetic Mean Deviation of the Profile (Ra) before and after long repeated use is relatively small. Namely, the developing roller B can maintain good toner scraping property and toner feeding property.

Figure 4A:
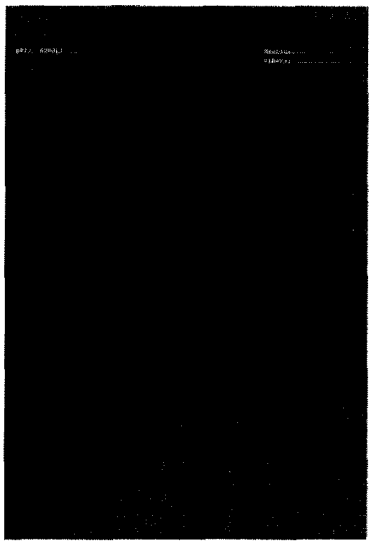
FIGS. 4A and 4B are schematic views illustrating solid images formed by two different developing rollers.
Figure 4B:
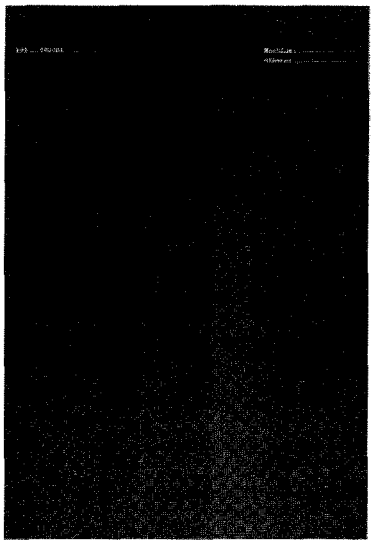

FIG. 4A illustrates a solid image formed by using the developing roller B, and FIG. 4B illustrates a solid image formed by using the developing roller A. In this regard, each of the solid images was recorded and developed in a direction of from the upper end of the image to the lower end thereof in FIGS. 4A and 4B.

It is clear from FIGS. 4A and 4B that the solid image in FIG. 4A, which is formed by using the developing roller B, has an even image density throughout the image, but the solid image in FIG. 4B, which is formed by using the developing roller A, has a low image density portion on a rear (lower) side thereof. The reason therefor is considered as follows. A relatively large amount of toner film is formed on the surface of the developing roller A and thereby the toner scraping ability (i.e., toner draw-up ability) of the developing roller A is deteriorated. When a solid image is developed with a developing roller, substantially all the toner on the developing roller is adhered to the solid image. Therefore, when the developing roller has poor toner scraping ability like the developing roller A, a low image density portion is formed on a rear side of the solid image. Therefore, the solid image in FIG. 4B, which is formed by using the developing roller A, has a low image density portion on a rear side thereof. Namely, the developing roller A has poor solid image reproducibility.

In contrast, since the amount of toner film on the developing roller B is small, the developing roller B maintains good toner scraping ability, and therefore the solid image can be satisfactorily developed, resulting in formation of a solid image having an even image density throughout the image. In general, the surface of a developing roller is typically roughened by sandblasting or the like to impart good toner scraping/feeding ability to the developing roller. If a thick toner film is formed on the roughened surface of the developing roller, the roughness of the surface decreases, thereby deteriorating the toner scraping/feeding ability of the developing roller.

The developing roller of this disclosure can be used for various types of developing devices. In addition, the developing device using the developing roller can be used for process cartridges and image forming apparatuses. Further, the developing roller of this disclosure can be used for image forming methods including a charging process to charge a surface of an image bearing member; an irradiating process to irradiate the charged surface of the image bearing member with light to form an electrostatic latent image on the surface of the image bearing member, a developing process to develop the electrostatic latent image with a toner on the developing roller to form a toner image on the surface of the image bearing member; a transferring process to transfer the toner image onto a recording medium; and a fixing process to fix the toner image to the recording medium.

The developing device, process cartridge, image forming apparatus and image forming method of this disclosure will be described by reference to FIGS. 5 and 6.

Figure 5:
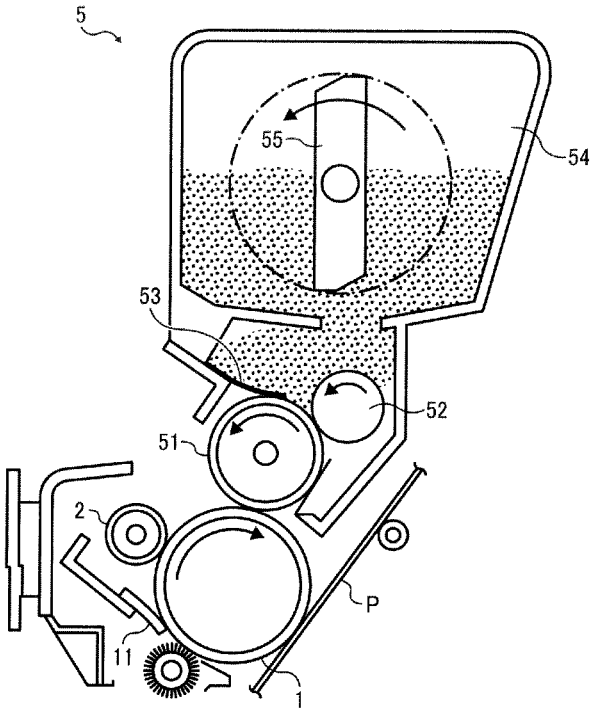
FIG. 5 is a schematic view illustrating a process cartridge according to an embodiment.

FIG. 5 illustrates a process cartridge of this disclosure, which includes a developing device of this disclosure including the developing roller mentioned above. FIG. 6 illustrates an image forming apparatus of this disclosure, which includes a developing device of this disclosure including the developing roller mentioned above.

Referring to FIG. 5, the process cartridge includes a photoreceptor drum 1 serving as an image bearing member; a charger 2 to charge a surface of the photoreceptor 1; a developing device 5 to develop an electrostatic latent image on the photoreceptor 1 with a toner T; and a cleaning blade 11 to clean the surface of the photoreceptor 1. These devices are integrated as a unit so as to be detachably attachable to an image forming apparatus.

The developing device 5 includes a developing roller 51, which is the developing roller of this disclosure and which bears the toner T on the surface thereof while rotating in a direction indicated by an arrow to develop the electrostatic latent image on the photoreceptor 1 with the toner T; a developer supplying member 52 to supply the toner T to the surface of the developing roller 51 while rotating in a direction indicated by an arrow; a developer regulating member 53 to regulate the toner supplied by the developer supplying member 52 to form a toner layer on the developing roller 51; a developer container 54 to contain the toner; and an agitator 55 to agitate the toner T in the developer container 54.

The image forming method of the process cartridge will be described.

The photoreceptor 1 is rotated in a direction indicated by an arrow, and the charger 2 charges the surface of the photoreceptor 1. Next, the charged photoreceptor 1 is exposed to light emitted by an irradiator (not shown in FIG. 5) based on image data at a position between the charger 2 and the developing roller 51 to form an electrostatic latent image on the surface of the photoreceptor 1. The electrostatic latent image on the surface of the photoreceptor 1 is developed with the toner on the developing roller 51 to form a toner image on the surface of the photoreceptor 1. The toner image on the photoreceptor 1 is then transferred onto a recording medium P. The recording medium P bearing the toner image thereon is fed to a fixing device of the image forming apparatus to which the process cartridge is attached. After the toner image is transferred, the surface of the photoreceptor 1 is cleaned by the cleaning blade 11 so that the photoreceptor is ready for the next image forming operation.

Next, the image forming apparatus of this disclosure will be described by reference to FIG. 6.

Figure 6:
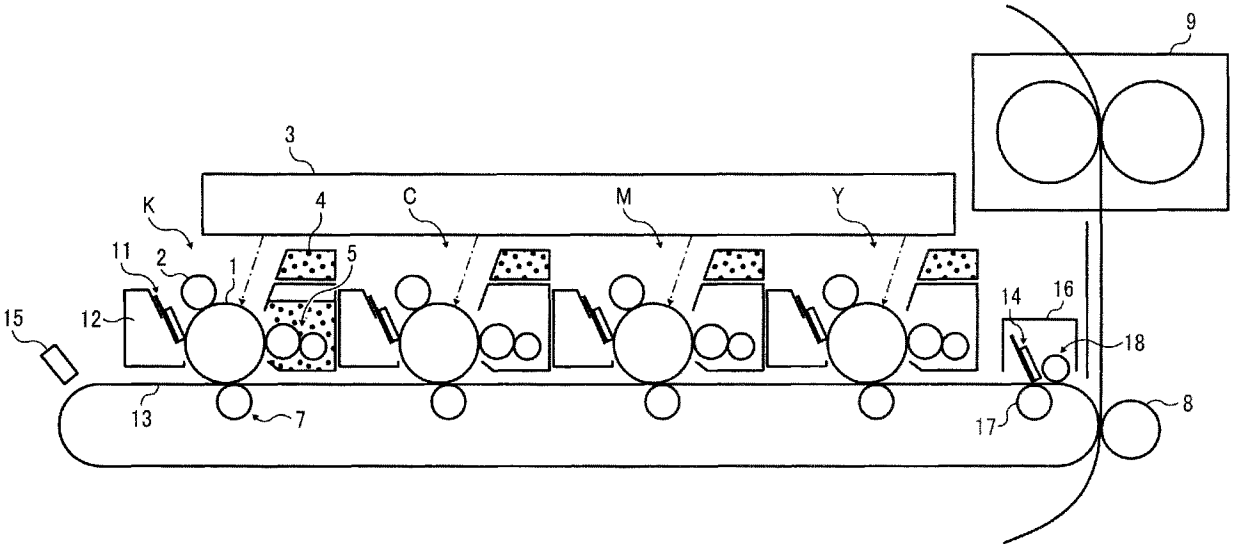
FIG. 6 is a schematic view illustrating an image forming apparatus according to an embodiment.

The image forming apparatus illustrated in FIG. 6 is a tandem full color image forming apparatus. The image forming apparatus includes four image forming sections Y, M, C and K, which have substantially the same structure except for using different color toners to form yellow (Y), magenta (M), cyan (C) and black (K) toner images. Each of the image forming sections includes the photoreceptor drum 1 serving as an image bearing member. Around the photoreceptor 1, the charger 2 to charge a surface of the photoreceptor 1; an irradiator 3 to irradiate the charged surface of the photoreceptor 1 with light based on image data to form an electrostatic latent image on the surface of the photoreceptor 1; the developing device 5, which is the developing device of this disclosure and which develops the electrostatic latent image on the photoreceptor 1 to form a toner image on the surface of the photoreceptor 1; a transferring device, which includes an intermediate transfer belt 13, a primary transfer roller 7 to transfer the toner image on the photoreceptor 1 to the intermediate transfer belt 13, and a secondary transfer roller 8 to transfer the toner image on the intermediate transfer belt 13 to the recording medium P; and a cleaner 12 including the cleaning blade 11 to clean the surface of the photoreceptor 1 are arranged in this order. A toner supply container 4 is provided above the developing device 5 so as to be connected with the developing device to supply the toner to the developing device 5. In this image forming apparatus, the toner is directly fed from the toner supply container 4 to the developing device 5. However, a passage may be provided so that the toner in the toner supply container 4 is fed to the developing device 5 through the passage.

In this tandem full color image forming apparatus, yellow (Y), magenta (M), cyan (C) and black (K) toner images are formed on the respective photoreceptors 1. When the image forming apparatus uses a nega-posi image forming method in which toner is adhered to an irradiated portion (i.e., a low potential portion) of the photoreceptor 1, the charger 2 evenly charges negatively the surface of the photoreceptor 1, and the irradiator 3 irradiates the charged surface of the photoreceptor 1 with light to form an electrostatic latent image on the surface of the photoreceptor 1. The developing device 5 develops the electrostatic latent image with a toner (i.e., yellow, magenta, cyan or black toner) to form yellow, magenta, cyan and black toner images on the respective photoreceptors 1. The color toner images on the photoreceptors 1 are sequentially transferred onto the intermediate transfer belt 13 to form a combined color toner image, in which the color toner images are overlaid, on the intermediate transfer belt 13. The toner remaining on the photoreceptor 1 without being transferred is removed therefrom by the cleaning blade 11 of the cleaner 12. The combined color toner image on the intermediate transfer belt 13 is transferred to the recording medium P, which is fed from a recording medium tray, by the secondary transfer roller 8 to which a transfer bias is applied. The residual toner on the intermediate transfer belt 13 is removed therefrom by a cleaning blade 14 of a belt cleaner 16. The recording medium P bearing the combined color toner image thereon is fed to the fixing device 9 and the combined color toner image is fixed to the recording medium. The recording medium P bearing the fixed color toner image thereon is discharged from the main body of the image forming apparatus.

In FIG. 6, numeral 15 denotes a sensor to check the amount of toner of each of Y, M, C and K toner images on the intermediate transfer belt 13 while checking the position of color toner images to adjust the image density and position of the color toner images. The sensor uses a sensing method using a combination of mirror reflection and diffuse reflection. The belt cleaner 16 includes the cleaning blade 14, which is contacted with the intermediate transfer belt 13 so as to counter the intermediate transfer belt, a counter metal roller 17 opposed to the cleaning blade 14, and a coil 18 which feeds the toner collected by the cleaning blade 14 to a waste toner container (not shown in FIG. 6).

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

1. Preparation of Electroconductive Elastic Layer

An epichlorohydrin rubber (HYDRIN T3106 from Nippon Zeon Co., Ltd.) was applied on the surface of a metal shaft (serving as a cylindrical electroconductive substrate) with a diameter of 6 mm to form an electroconductive elastic layer with a thickness of 3 mm. The surface of the electroconductive elastic layer was subjected to lapping and polishing using a rubber roller grinder (LEO-600-F4L-BME from MINAKUCHI MACHINERY WORKS LTD.), and the surface of the electroconductive elastic layer was further grinded by a grinder (SZC from MINAKUCHI MACHINERY WORKS LTD.). Thus, a roller substrate 1 having an electroconductive elastic layer thereon was prepared.

2. Preparation of Toner Bearing Layer (NCO/OH Molar Ratio of 100)

The following components were mixed to prepare a toner bearing layer coating liquid.

| | |
|---|---|
| Isocyanurate of hexamethylene diisocyanate (D170N from Mitsui Chemicals, Inc.) | 1 part |
| Fluorine-containing polyol (LUMIFLON LF200MEK from Asahi Glass Co., Ltd.) | 0.099 parts |
| Carbon black (from Fuji Pigment Co., Ltd.) | 0.22 parts |
| Butyl acetate | 1 part |
| Ethyl acetate | 9 parts |

Next, 0.1 parts of a catalyst (NEOSTAN U-820 from NITTO KASEI CO., LTD.) was added to the mixture to prepare a toner bearing layer coating liquid.

The toner bearing layer coating liquid was applied on the surface of the electroconductive elastic layer of the roller substrate 1 by spray coating, followed by a heat treatment for 0.5 hours at 130° C. and an annealing treatment for 1 hour at 145° C. to thermally cure the toner bearing layer. Thus, a developing roller of Example 1 was prepared.

Example 2

1. Preparation of Electroconductive Elastic Layer

An epichlorohydrin rubber (HYDRIN T3106 from Nippon Zeon Co., Ltd.) was applied on the surface of a metal shaft with a diameter of 6 mm to form an electroconductive elastic layer with a thickness of 3 mm. The surface of the electroconductive elastic layer was subjected to lapping and polishing using a rubber roller grinder (LEO-600-F4L-BME from MINAKUCHI MACHINERY WORKS LTD.). Thus, a roller substrate 2 having an electroconductive elastic layer thereon was prepared.

2. Preparation of Toner Bearing Layer (NCO/OH Molar Ratio of 100)

The procedure for preparation of the toner bearing layer in Example 1 was repeated to form the toner bearing layer on the surface of the electroconductive elastic layer of the roller substrate 2.

Thus, a developing roller of Example 2 was prepared.

Example 3

1. Preparation of Electroconductive Elastic Layer

An epichlorohydrin rubber (HYDRIN T3106 from Nippon Zeon Co., Ltd.) was applied on the surface of a metal shaft with a diameter of 6 mm to form an electroconductive elastic layer with a thickness of 3 mm. The surface of the electroconductive elastic layer was subjected to lapping and polishing using a rubber roller grinder (LEO-600-F4L-BME from MINAKUCHI MACHINERY WORKS LTD.). In addition, the surface of the electroconductive elastic layer was grinded using a tape to which a grinding powder is adhered. Thus, a roller substrate 3 having an electroconductive elastic layer thereon was prepared.

2. Preparation of Toner Bearing Layer (NCO/OH Molar Ratio of 100)

The procedure for preparation of the toner bearing layer in Example 1 was repeated to form the toner bearing layer on the surface of the electroconductive elastic layer of the roller substrate 3.

Thus, a developing roller of Example 3 was prepared.

Example 4

1. Preparation of Electroconductive Elastic Layer

The roller substrate 1 prepared in Example 1 was used.

2. Preparation of Toner Bearing Layer (NCO/OH Molar Ratio of 90)

The following components were mixed to prepare a toner bearing layer coating liquid.

| | |
|---|---|
| Isocyanurate of hexamethylene diisocyanate (D170N from Mitsui Chemicals, Inc.) | 1 part |
| Fluorine-containing polyol (LUMIFLON LF200MEK from Asahi Glass Co., Ltd.) | 0.1097 parts |
| Carbon black (from Fuji Pigment Co., Ltd.) | 0.22 parts |
| Butyl acetate | 1 part |
| Ethyl acetate | 9 parts |

Next, 0.1 parts of a catalyst (NEOSTAN U-820 from NITTO KASEI CO., LTD.) was added to the mixture to prepare a toner bearing layer coating liquid.

The toner bearing layer coating liquid was applied on the surface of the electroconductive elastic layer of the roller substrate 1 by spray coating, followed by a heat treatment for 0.5 hours at 130° C. and an annealing treatment for 1 hour at 145° C. to thermally cure the toner bearing layer. Thus, a developing roller of Example 4 was prepared.

Example 5

1. Preparation of Electroconductive Elastic Layer

The roller substrate 1 prepared in Example 1 was used.

2. Preparation of Toner Bearing Layer (NCO/OH Molar Ratio of 110)

The following components were mixed to prepare a toner bearing layer coating liquid.

| | |
|---|---|
| Isocyanurate of hexamethylene diisocyanate (D170N from Mitsui Chemicals, Inc.) | 1 part |
| Fluorine-containing polyol (LUMIFLON LF200MEK from Asahi Glass Co., Ltd.) | 0.0897 parts |
| Carbon black (from Fuji Pigment Co., Ltd.) | 0.22 parts |
| Butyl acetate | 1 part |
| Ethyl acetate | 9 parts |

Next, 0.1 parts of a catalyst (NEOSTAN U-820 from NITTO KASEI CO., LTD.) was added to the mixture to prepare a toner bearing layer coating liquid.

The toner bearing layer coating liquid was applied on the surface of the electroconductive elastic layer of the roller substrate 1 by spray coating, followed by a heat treatment for 0.5 hours at 130° C. and an annealing treatment for 1 hour at 145° C. to thermally cure the toner bearing layer. Thus, a developing roller of Example 5 was prepared.

Example 6

1. Preparation of Electroconductive Elastic Layer

A mixture of 6 parts of an epichlorohydrin rubber (HYDRIN T3106 from Nippon Zeon Co., Ltd.) and 4 parts of an acrylonitrile-butadiene rubber (DN401L from Nippon Zeon Co., Ltd.) was applied on the surface of a metal shaft with a diameter of 6 mm to form an electroconductive elastic layer with a thickness of 3 mm. The surface of the electroconductive elastic layer was subjected to lapping and polishing using a rubber roller grinder (LEO-600-F4L-BME from MINAKUCHI MACHINERY WORKS LTD.). Thus, a roller substrate 6 having an electroconductive elastic layer thereon was prepared.

2. Preparation of Toner Bearing Layer (NCO/OH Molar Ratio of 95)

The following components were mixed to prepare a toner bearing layer coating liquid.

| | |
|---|---|
| Isocyanurate of tolylene diisocyanate (D262 from Mitsui Chemicals, Inc.) | 1 part |
| Polyurethane polyol (A2789 from Mitsui Chemicals, Inc.) | 0.291 parts |
| Silicone-grafted acrylic resin (MODIPER FS720 from NOF Corporation) | 0.1 parts |
| Carbon black (from Fuji Pigment Co., Ltd.) | 0.25 parts |
| Methyl ethyl ketone | 0.291 parts |
| Butyl acetate | 1 part |
| Ethyl acetate | 9 parts |

Next, 0.1 parts of a catalyst (NEOSTAN U-820 from NITTO KASEI CO., LTD.) was added to the mixture to prepare a toner bearing layer coating liquid.

The toner bearing layer coating liquid was applied on the surface of the electroconductive elastic layer of the roller substrate 6 by spray coating, followed by a heat treatment for 0.5 hours at 130° C. and an annealing treatment for 1 hour at 145° C. to thermally cure the toner bearing layer. Thus, a developing roller of Example 6 was prepared.

Example 7

1. Preparation of Electroconductive Elastic Layer

A mixture of 6 parts of an epichlorohydrin rubber (HYDRIN T3106 from Nippon Zeon Co., Ltd.) and 4 parts of an acrylonitrile-butadiene rubber (DN401L from Nippon Zeon Co., Ltd.) was applied on the surface of a metal shaft with a diameter of 6 mm to form an electroconductive elastic layer with a thickness of 3 mm. The surface of the electroconductive elastic layer was subjected to lapping and polishing using a rubber roller grinder (LEO-600-F4L-BME from MINAKUCHI MACHINERY WORKS LTD.), and the surface of the electroconductive elastic layer was further grinded by a grinder (SZC from MINAKUCHI MACHINERY WORKS LTD.). Thus, a roller substrate 7 having an electroconductive elastic layer thereon was prepared.

2. Preparation of Toner Bearing Layer (NCO/OH Molar Ratio of 105)

The following components were mixed to prepare a toner bearing layer coating liquid.

| | |
|---|---|
| Isocyanurate of totylene diisocyanate (D262 from Mitsui Chemicals, Inc.) | 1 part |
| Silicone-grafted polyol (GS1015 from Toa Gosei Chemical Industry Co., Ltd.) | 0.017 parts |
| Carbon black (from Fuji Pigment Co., Ltd.) | 0.25 parts |
| Butyl acetate | 1 part |
| Ethyl acetate | 9 parts |

Next, 0.1 parts of a catalyst (NEOSTAN U-820 from NITTO KASEI CO., LTD.) was added to the mixture to prepare a toner bearing layer coating liquid.

The toner bearing layer coating liquid was applied on the surface of the electroconductive elastic layer of the roller substrate 7 by spray coating, followed by a heat treatment for 0.5 hours at 130° C. and an annealing treatment for 1 hour at 145° C. to thermally cure the toner bearing layer. Thus, a developing roller of Example 7 was prepared.

Example 8

1. Preparation Of Electroconductive Elastic Layer

The roller substrate 6 prepared in Example 6 was used.

2. Preparation of Toner Bearing Layer (NCO/OH Molar Ratio of 100)

The following components were mixed to prepare a toner bearing layer coating liquid.

| | |
|---|---|
| Isocyanurate of tolylene diisocyanate (D262 from Mitsui Chemicals, Inc.) | 1 part |
| Polyurethane polyol (A2789 from Mitsui Chemicals, Inc.) | 0.276 parts |

-continued

| | |
|---|---|
| Polyglycerin fatty acid ester (IS-202P from Sakamoto Yakuhin Kogyo Co., Ltd.) | 0.05 parts |
| Carbon black (from Fuji Pigment Co., Ltd.) | 0.24 parts |
| Methyl ethyl ketone | 0.276 parts |
| Butyl acetate | 1 part |
| Ethyl acetate | 9 parts |

Next, 0.1 parts of a catalyst (NEOSTAN U-820 from NITTO KASEI CO., LTD.) was added to the mixture to prepare a toner bearing layer coating liquid.

The toner bearing layer coating liquid was applied on the surface of the electroconductive elastic layer of the roller substrate 6 by spray coating, followed by a heat treatment for 0.5 hours at 130° C. and an annealing treatment for 1 hour at 145° C. to thermally cure the toner bearing layer. Thus, a developing roller of Example 8 was prepared.

Example 9

1. Preparation of Electroconductive Elastic Layer

The roller substrate 1 prepared in Example 1 was used.

2. Preparation of Toner Bearing Layer (NCO/OH Molar Ratio of 108)

The following components were mixed to prepare a toner bearing layer coating liquid.

| | |
|---|---|
| Isocyanurate of hexamethylene diisocyanate (D170N from Mitsui Chemicals, Inc.) | 1 part |
| Perfluoroalkyl group containing oligomer (MEGAFACE F477 from DIC Corporation) | 0.15 parts |
| Carbon black (from Fuji Pigment Co., Ltd.) | 0.24 parts |
| Butyl acetate | 1 part |
| Ethyl acetate | 9 parts |

Next, 0.1 parts of a catalyst (NEOSTAN U-820 from NITTO KASEI CO., LTD.) was added to the mixture to prepare a toner bearing layer coating liquid.

The toner bearing layer coating liquid was applied on the surface of the electroconductive elastic layer of the roller substrate 1 by spray coating, followed by a heat treatment for 0.5 hours at 130° C. and an annealing treatment for 1 hour at 145° C. to cure the toner bearing layer. Thus, a developing roller of Example 9 was prepared.

Comparative Example 1

1. Preparation of Electroconductive Elastic Layer

The roller substrate 1 prepared in Example 1 was used.

2. Preparation of Toner Bearing Layer (NCO/OH Molar Ratio of 100)

The following components were mixed to prepare a toner bearing layer coating liquid.

| | |
|---|---|
| Isocyanurate of hexamethylene diisocyanate (D170N from Mitsui Chemicals, Inc.) | 1 part |
| Polyurethane polyol (A2789 from Mitsui Chemicals, Inc.) | 0.276 parts |

-continued

| | |
|---|---|
| Carbon black (from Fuji Pigment Co., Ltd.) | 0.23 parts |
| Methyl ethyl ketone | 0.276 parts |
| Butyl acetate | 1 part |
| Ethyl acetate | 9 parts |

Next, 0.1 parts of a catalyst (NEOSTAN U-820 from NITTO KASEI CO., LTD.) was added to the mixture to prepare a toner bearing layer coating liquid.

The toner bearing layer coating liquid was applied on the surface of the electroconductive elastic layer of the roller substrate 1 by spray coating, followed by a heat treatment for 0.5 hours at 130° C. and an annealing treatment for 1 hour at 145° C. to thermally cure the toner bearing layer. Thus, a developing roller of Comparative Example 1 was prepared.

Comparative Example 2

1. Preparation of Electroconductive Elastic Layer

The roller substrate 1 prepared in Example 1 was used.

2. Preparation of Toner Bearing Layer (NCO/OH Molar Ratio of 85)

The following components were mixed to prepare a toner bearing layer coating liquid.

| | |
|---|---|
| Isocyanurate of hexamethylene diisocyanate (D170N from Mitsui Chemicals, Inc.) | 1 part |
| Fluorine-containing polyol (LUMIFLON LF200MEK from Asahi Glass Co., Ltd.) | 0.1162 parts |
| Carbon black (from Fuji Pigment Co., Ltd.) | 0.23 parts |
| Butyl acetate | 1 part |
| Ethyl acetate | 9 parts |

Next, 0.1 parts of a catalyst (NEOSTAN U-820 from NITTO KASEI CO., LTD.) was added to the mixture to prepare a toner bearing layer coating liquid.

The toner bearing layer coating liquid was applied on the surface of the electroconductive elastic layer of the roller substrate 1 by spray coating, followed by a heat treatment for 0.5 hours at 130° C. and an annealing treatment for 1 hour at 145° C. to thermally cure the toner bearing layer. Thus, a developing roller of Comparative Example 2 was prepared.

Comparative Example 3

1. Preparation of Electroconductive Elastic Layer

The roller substrate 1 prepared in Example 1 was used.

2. Preparation of Toner Bearing Layer (NCO/OH Molar Ratio of 115)

The following components were mixed to prepare a toner bearing layer coating liquid

| | |
|---|---|
| Isocyanurate of hexamethylene diisocyanate (D170N from Mitsui Chemicals, Inc.) | 1 part |
| Fluorine-containing polyol (LUMIFLON LF200MEK from Asahi Glass Co., Ltd.) | 0.0858 parts |
| Carbon black (from Fuji Pigment Co., Ltd.) | 0.22 parts |

-continued

| | |
|---|---|
| Butyl acetate | 1 part |
| Ethyl acetate | 9 parts |

Next, 0.1 parts of a catalyst (NEOSTAN U-820 from NITTO KASEI CO., LTD.) was added to the mixture to prepare a toner bearing layer coating liquid.

The toner bearing layer coating liquid was applied on the surface of the electroconductive elastic layer of the roller substrate 1 by spray coating, followed by a heat treatment for 0.5 hours at 130° C. and an annealing treatment for 1 hour at 145° C. to cure the toner bearing layer. Thus, a developing roller of Comparative Example 3 was prepared.

Comparative Example 4

The developing roller disclosed in Example 3 of JP-2011-215467-A was prepared as a developing roller of Comparative Example 4. Specifically, the preparation method is as follows.

1. Preparation of Electroconductive Inner Layer (Corresponding to the Electroconductive Elastic Layer in this Application)

Initially, a polyether polyol (EXCENOL S3003 from Asahi Glass Co., Ltd. having a hydroxyl value of 56 mgKOH/g and a weight average molecular weight of 3,000), in which an electroconductive carbon black (45L from Mitsubishi Chemical Corporation) is dispersed in an amount of 5% by weight, was subjected to a roll dispersing treatment. Next, in order to impart a predetermined urethane hardness to the inner layer, a polyoxyalkylene polyol (SUMIPHEN™ from Sumika Bayer Urethane Co., Ltd. having a hydroxyl value of 363 mgKOH/g and a weight average molecular weight of 400) was added to the polyether polyol. This mixture was used as a polyol component.

In addition, a dimethylfatty acid monocarboxylic acid salt (UL28 from Katsuzai-Chemical Corporation) was added as a reaction accelerating catalyst in an amount of 50 ppm based on the total weight of the urethane component.

Further, 100 g of the mixture of the polyols and the catalyst (i.e., the base component) was mixed with 13 g of an isocyanate (hardener), 1,3-bis(isocyanatemethyl)benzene metaxylene diisocyanate (TAKENATE T500 from MITSUI TAKEDA CHEMICALS, INC.), and the mixture was fed into a die, followed by curing for 8 minutes at 125° C. Next, the molded material was aged for 8 hours at room temperature.

The surface of the molded material was grinded so that the molded material has the predetermined size. Further, the surface was grinded using an abrasive tape (C#800) to control the surface roughness of the inner layer. Thus, an electroconductive inner layer was formed on the peripheral surface of a cylinder.

2. Preparation of Coat Layer (Corresponding to the Toner Bearing Layer in this Application)

The following components were mixed to prepare a coat layer coating liquid.

| | |
|---|---|
| Acrylic resin serving as a binder resin (acrylic resin having an amino group in a side chain, NK380 from Nippon Shokubai Co., Ltd. having a solid content of 30%) | 100 parts |

-continued

| | |
|---|---|
| Fluorine-containing urethane resin (DIAROMER FF 121DN from Dainichiseika Color & Chemical Mfg. Co., Ltd. having a solid content of 35%) | 7 parts |
| Carbon black dispersion serving as electric resistance adjuster (SEIKA BLACK SS-01-942 from Dainichiseika Color & Chemical Mfg. Co., Ltd. having a solid content of 24%) | 20 parts |
| Silicone oil serving as surface modifier (FM0721 from Chisso Corporation) | 0.25 parts |

In addition, a mixture solvent including tetrahydrofuran and methyl ethyl ketone in a weight ratio of 7:3 was added to the mixture so that the solid content of the binder resin components in the coating liquid is 3.0%. Thus, the coat layer coating liquid was prepared.

The cylinder bearing the electroconductive inner layer was coated with the coat layer coating liquid by dip coating, followed by heating for 2 hours at 100° C. to prepare a coat layer with a thickness of 2 μm to 3 μm.

Thus, a developing roller of Comparative Example 4 was prepared.

The above-prepared developing rollers of Examples 1-9 and Comparative Examples 1-4 were evaluated with respect to the following properties.

1. Water Contact Angle

The water contact angle of the toner bearing layer was measured under an environmental condition 23° C. and 45% RH using an automatic contact angle meter DM-501 from Kyowa Interface Science Co., Ltd. Specifically, water was dropped on the surface of the developing roller, and the contact angle of the water drop was measured at regular intervals of 10 seconds within an elapsed time of 60 seconds to determine the average value. In this regard, a developing roller having a higher water contact angle has a lower surface energy and a better releasability.

2. Si Peak Intensity (i.e., Toner Filming Property)

Silica included in the external additive tends to be easily adhered to the surface of the developing roller, and the amount of silica increases when the developing roller is repeatedly used. Therefore, the used developing roller was subjected to a FT-IR ATR (attenuated total reflection) analysis to determine the intensity of the Si peak, which is used as an index of the degree (amount) of the toner film on the developing roller.

Specifically, the developing roller was set in an image forming apparatus, IPSIO SP C310 from Ricoh Co., Ltd., and a running test in which 5,000 copies of an original chart with an image area proportion of 1% was performed. After the running test, the developing roller was detached from the image forming apparatus, and toner remaining on the surface of the developing roller was removed therefrom by an air blower. The surface of the developing roller was subjected to a FT-IR ATR analysis using an instrument NEXUS 470 from Thermo Nicolet. The intensity of the peak of Si (observed around 470 $cm^{-1}$) was determined from the obtained absorption spectrum. In this regard, the greater the Si peak intensity, the greater the amount of toner film formed on the developing roller.

The toner filming property of the developing roller was graded as follows.

◎: The Si peak intensity is less than 0.05. (Excellent)

○: The Si peak intensity is not less than 0.05 and less than 0.1. (Good)

Δ: The Si peak intensity is not less than 0.1 and less than 0.3. (Acceptable)

x: The Si peak intensity is not less than 0.3. (Unacceptable)

In this regard, the toner used for the running test was not the genuine toner of the image forming apparatus, and the toner of Example 2 in JP-2011-123483-A was used.

Specifically, the toner was prepared as follows.

(1) Synthesis of Polyester 1

The following components were fed into a reaction vessel equipped with a condenser, an agitator and a nitrogen feed pipe to be reacted for 8 hours at 230° C. under normal pressure.

| | |
|---|---|
| Ethylene oxide adduct (2 mole) of bisphenol A | 2765 parts |
| Propylene oxide adduct (2 mole) of bisphenol A | 480 parts |
| Terephthalic acid | 1100 parts |
| Adpic acid | 225 parts |
| Dibutyltin oxide | 10 parts |

The reaction was further continued for 5 hours under a reduced pressure of from 10 mmHg to 15 mmHg (1333 Pa to 2000 Pa).

Further, 130 parts of trimellitic anhydride was added to the reaction vessel, and the mixture was reacted for 2 hours at 180° C. under normal pressure. Thus, a polyester 1, which has a number average molecular weight of 2,200, a weight average molecular weight of 5,600, a glass transition temperature (Tg) of 43° C., and an acid value of 24 mgKOH/g, was prepared.

(2) Synthesis of Polyester 3

The following components were fed into a reaction vessel equipped with a condenser, an agitator and a nitrogen feed pipe to be reacted for 8 hours at 230° C. under normal pressure.

| | |
|---|---|
| Ethylene oxide adduct (2 mole) of bisphenol A | 264 parts |
| Propylene oxide adduct (2 mole) of bisphenol A | 523 parts |
| Terephthalic acid | 123 parts |
| Adpic acid | 173 parts |
| Dibutyltin oxide | 1 part |

The reaction was further continued for 8 hours under a reduced pressure of from 10 mmHg to 15 mmHg (1333 Pa to 2000 Pa).

Further, 26 parts of trimellitic anhydride was added to the reaction vessel, and the mixture was reacted for 2 hours at 180° C. under normal pressure. Thus, a polyester 3, which has a number average molecular weight of 4,000, a weight average molecular weight of 47,000, a glass transition temperature (Tg) of 65° C., and an acid value of 12 mgKOH/g, was prepared.

(3) Synthesis of Polyester 4 (Crystalline Polyester)

The following components were fed into a reaction vessel equipped with a condenser, an agitator and a nitrogen feed pipe to be reacted for 8 hours at 200° C. under normal pressure.

| | |
|---|---|
| 1,6-Hexanediol | 500 parts |
| Succinic acid | 500 parts |
| Dibutyltin oxide | 2.5 parts |

The reaction was further continued for 1 hour under a reduced pressure of from 10 mmHg to 15 mmHg (1333 Pa to 2000 Pa). Thus, a polyester 4, which has an absorption peak at 65° C. in a DSC (differential scanning calorimetric) analysis, was prepared.

(4) Preparation of Particulate Vinyl Copolymer V-1

The following components were fed into a reaction vessel equipped with a condenser, an agitator and a nitrogen feed pipe.

| | |
|---|---|
| Sodium dodecyl sulfate | 1.6 parts |
| Ion-exchange water | 492 parts |

After the mixture was heated to 80° C., an aqueous solution of potassium persulfate in which 2.5 parts of potassium persulfate is dissolved in 100 parts of ion-exchange water was added thereto. After the mixture was agitated for 15 minutes, a mixture of 200 parts of styrene monomer and 3.5 parts of n-octylmercaptan was dropped into the mixture over 90 minutes. The mixture was heated for 60 minutes at 80° C., followed by cooling. Thus, a vinyl copolymer resin dispersion V-1 having a solid content of 25% and a volume average particle diameter of 130 nm was prepared. It was confirmed that the solid vinyl copolymer, which was obtained by evaporating the dispersing medium in the dispersion, has a number average molecular weight of 11,000, a weight average molecular weight of 18,000, and a glass transition temperature (Tg) of 83° C.

(5) Preparation of Master Batch

The following components were mixed with a HENSCHEL MIXER mixer.

| | |
|---|---|
| Water | 30 parts |
| Carbon black (REGAL 400R from Cabot Corporation) | 40 parts |
| Polyester resin | 60 parts |

(RS801 from Sanyo Chemical Industries Ltd, having an acid value of 10 mgKOH/g, a weight average molecular weight of 20,000 and a glass transition temperature (Tg) of 64° C.)

The mixture was kneaded with a twin roll mill for 45 minutes at 130° C., followed by roll cooling and pulverization using a pulverizer. Thus, a master batch 1 having a particle size of 1 mm was prepared.

(6) Preparation of Oil Phase Liquid

The following components were fed into a reaction vessel equipped with agitator and a thermometer to be mixed.

| | |
|---|---|
| Polyester 1 prepare above | 4 parts |
| Polyester 4 prepare above | 20 parts |
| Paraffin wax having a melting point of 72° C. | 8 parts |
| Ethyl acetate | 96 parts |

The mixture was heated for 5 hours at 80° C. while agitated. The mixture was then cooled to 30° C. over 1 hour.

After the mixture was mixed with 35 parts of the master batch 1, the mixture was agitated for 1 hour. The mixture was fed to another container and subjected to bead milling using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Thus, a raw material solution 1 was prepared.

Next, the following components were mixed for 2 hours using a three-one motor.

| | |
|---|---|
| Raw material solution 1 prepared above | 81.3 parts |
| 70% ethyl acetate solution of polyester 1 | 74.1 parts |
| Polyester 3 prepared above | 21.6 parts |
| Ethyl acetate | 21.5 parts |

Thus, an oil phase liquid 1 was prepared. The oil phase liquid was diluted with ethyl acetate so as to have a solid content of 49% by weight, which was determined by drying the oil phase liquid for 30 minutes at 130° C.

(7) Preparation of Aqueous Phase Liquid

The following components were mixed,

| | |
|---|---|
| Ion-exchange water | 472 parts |
| Aqueous solution of sodium salt of dodecyldiphenyletherdisulfonic acid (ELEMINOL MON-7 from Sanyo Chemical Industries Ltd., solid content of 50%) | 81 parts |
| 1% aqueous solution of carboxymethyl cellulose (serving as thickener) | 67 parts |
| Ethyl acetate | 54 parts |

Thus, an aqueous phase liquid 1, which is a milk white liquid, was prepared.

(8) Emulsification

After the above-prepared oil phase liquid (198.5 parts) was agitated for 1 minute using a TK HOMOMIXER mixer from Tokushu Kika Kogyo Co., Ltd. rotated at 5,000 rpm, 321 parts of the aqueous phase liquid was added thereto, and the mixture was agitated for 20 minutes using the TK HOMOMIXER mixer whose revolution was adjusted in a range of from 8,000 rpm to 13,000 rpm. Thus, a core particle slurry 1 was prepared.

(9) Adhesion of Particulate Resin to Core Particle (Formation of Core-Shell Particle)

While the core particle slurry 1 was agitated by a three-one motor, which was rotated at a revolution of 200 rpm, 21.4 parts of the vinyl copolymer dispersion V-1 prepared above was added thereto over 5 minutes, and the mixture was agitated for 30 minutes by the three-one motor. One (1) part of the mixture was sampled and diluted with 10 parts of water, and the diluted sample was subjected to centrifugal separation. As a result, toner particles were precipitated and the supernatant liquid was substantially clear.

Thus, a core-shell slurry 1 was prepared.

(10) Solvent Removal

The above-prepared core-shell slurry 1 was fed into a container equipped with an agitator and a thermometer to be subjected to a solvent removal treatment for 8 hours at 30° C.

Thus, a dispersion slurry 1 was prepared.

(11) Washing and Drying

One hundred (100) parts of the dispersion slurry was filtered under a reduced pressure.

The wet cake was mixed with 100 parts of ion-exchange water and the mixture was agitated for 10 minutes with a TK HOMOMIXER mixer at a revolution of 12,000 rpm, followed by filtration. Thus, a wet cake (a) was prepared.

The thus prepared wet cake (a) was mixed with 100 parts of ion-exchange water and the mixture was agitated for 10 minutes with the TK HOMOMIXER mixer at a revolution of 12,000 rpm while applying ultrasonic vibration thereto, followed by filtration. This operation was repeated until the resultant slurry had an electroconductivity of not greater than 10 μS/cm.

The slurry was mixed with a 10% hydrochloric acid so that the mixture has a pH of 4, and the mixture was agitated for 30 minutes by a three-one motor, followed by filtering to prepare a wet cake (b).

The thus prepared wet cake (b) was mixed with 100 parts of ion-exchange water and the mixture was agitated for 10 minutes with the TK HOMOMIXER mixer, followed by filtration. This operation was repeated until the resultant slurry had an electroconductivity of not greater than 10 μS/cm. Thus, a filtered cake 1 was prepared.

The filtered cake 1 was dried for 48 hours at 45° C. using a circulation air drier, followed by screening with a sieve having openings of 75 μm.

Thus, toner particles 1 (mother toner 1) were prepared.

(12) Preparation of Toner

Fifty (50) parts of the toner particles 1 were mixed with 1 part of a hydrophobized silica, which is treated with a silicone oil and which has an average primary particle diameter of about 30 nm, and 0.5 parts of a hydrophobized titanium oxide having an average primary particle diameter of about 10 nm using a HENSCHEL MIXER mixer.

Thus, a toner (developer), which is the same as the toner of Example 2 in JP-2011-123483-A, was prepared. This toner was used for the evaluation of Si peak intensity (toner filming property).

3. Solid Image Reproducibility

After a 5,000-copy running test, which is the same as the above-mentioned 5,000-copy running test except for using a different toner, was performed, two copies of the solid image illustrated in FIG. 4 were continuously produced, and the second copy was visually observed to determine whether the copy has a low image density portion.

The solid image reproducibility of the developing roller was graded as follows.

◎: The solid image has no low image density portion. (Excellent)

○: The solid image has a slightly low image density portion at a rear end portion, but the quality is of an acceptable level. (Good)

x: The solid image has a seriously low image density portion at a rear end portion, and the quality is of an unacceptable level. (Unacceptable)

In this regard, the toner used for the running test was not the genuine toner of the image forming apparatus, and the toner described in Example 1 of JP-2007-279689-A was used. Specifically, the toner was prepared as follows.

(1) Synthesis of Polyester Resin 1

The following components were fed into a reaction vessel equipped with a condenser, an agitator and a nitrogen feed pipe to be reacted for 8 hours at 230° C. under normal pressure.

| | |
|---|---|
| Ethylene oxide adduct (2 mole) of bisphenol A | 553 parts |
| Propylene oxide adduct (2 mole) of bisphenol A | 196 parts |
| Terephthalic acid | 220 parts |
| Adpic acid | 45 parts |
| Dibutyltin oxide | 2 parts |

The reaction was further continued for 5 hours under a reduced pressure of from 10 mmHg to 15 mmHg (1333 Pa to 2000 Pa).

Further, 46 parts of trimellitic anhydride was added to the reaction vessel, and the mixture was reacted for 2 hours at 180° C. under normal pressure. Thus, a polyester resin 1, which has a number average molecular weight of 2,200, a weight average molecular weight of 5,600, a glass transition temperature (Tg) of 43° C., and an acid value of 13 mgKOH/g, was prepared.

(2) Synthesis of Vinyl Copolymer P1

The following components were fed into a reaction vessel equipped with a condenser, an agitator and a nitrogen feed pipe.

| | |
|---|---|
| Sodium dodecyl sulfate | 1.6 parts |
| Ion-exchange water | 492 parts |

After the mixture was heated to 80° C., an aqueous solution of potassium persulfate in which 2.5 parts of potassium persulfate (serving as a polymerization initiator) is dissolved in 100 parts of ion-exchange water was added thereto. After the mixture was agitated for 15 minutes, a mixture of 120 pans of styrene monomer, 51 parts of butyl acrylate, 29 parts of methacrylic acid, and 4.1 parts of n-octylmercaptan (serving as a molecular weight adjuster) was dropped into the mixture over 90 minutes. The mixture was heated for 60 minutes at 80° C., followed by cooling. Thus, a latex was prepared. After the latex was dried at 40° C. by blowing air, the particles were further dried at 40° C. under a reduced pressure. Thus, a vinyl copolymer P1, which has a weight average molecular weight of 12,500, a glass transition temperature of 50° C., and an acid value of 95 mgKOH/g, was prepared.

(3) Synthesis of Prepolymer 1

The following components were fed into a reaction vessel equipped with a condenser, an agitator and a nitrogen feed pipe to be reacted for 8 hours at 230° C. under normal pressure.

| | |
|---|---|
| Ethylene oxide adduct (2 mole) of bisphenol A | 682 parts |
| Propylene oxide adduct (2 mole) of bisphenol A | 81 parts |
| Terephthalic acid | 283 parts |
| Trimellitic anhydride | 22 parts |
| Dibutyltin oxide | 2 parts |

The reaction was further continued for 5 hours under a reduced pressure of from 10 mmHg to 15 mmHg (1333 Pa to 2000 Pa). Thus, an intermediate resin 1, which has a number average molecular weight of 2,100, a weight average molecular weight of 9,500, a glass transition temperature (Tg) of 55° C., an acid value of 0.5 mgKOH/g, and a hydroxyl value of 49 mgKOH/g, was prepared.

The following components were fed into a reaction vessel equipped with a condenser, an agitator and a nitrogen feed pipe to be reacted for 5 hours at 100° C.

| | |
|---|---|
| Intermediate resin 1 prepared above | 411 parts |
| Isophorone diisocyanate | 89 parts |
| Ethyl acetate | 500 parts |

Thus, a prepolymer 1, which includes free isocyanate in an amount of 1.53% by weight, was prepared.

(4) Preparation of Master Batch

The following components were mixed with a HENSCHEL MIXER mixer.

| | |
|---|---|
| Water | 30 parts |
| Carbon black (REGAL 400R from Cabot Corporation) | 40 parts |
| Polyester resin | 60 parts |

(RS801 from Sanyo Chemical Industries Ltd. having an acid value of 10 mgKOH/g, a weight average molecular weight of 20,000 and a glass transition temperature (Tg) of 64° C.)

The mixture was kneaded with a twin roll mill for 45 minutes at 130° C., followed by roll cooling and pulverization using a pulverizer. Thus, a master batch 1 having a particle size of 1 mm was prepared.

(5) Preparation of Oil Phase Liquid

The following components were fed into a reaction vessel equipped with an agitator and a thermometer to be mixed.

| | |
|---|---|
| Polyester resin 1 prepare above | 378 parts |
| Paraffin wax (HNP 9 from NIPPON SEIRO CO., LTD.) | 120 parts |
| Ethyl acetate | 1450 parts |

The mixture was heated for 5 hours at 80° C. while agitated. The mixture was then cooled to 30° C. over 1 hour.

After the mixture was mixed with 500 parts of the master batch 1 and 500 parts of ethyl acetate, the mixture was agitated for 1 hour. Thus, a raw material liquid 1 was prepared.

Next, 1,500 parts of the raw material liquid 1 was fed into another container and subjected to bead milling using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Next, 655 parts of a 65% ethyl acetate solution of the polyester resin 1 was added thereto, and the mixture was further subjected to bead milling under the above-mentioned conditions except that the dispersing operation was performed only once.

Thus, an oil phase liquid 1, which was diluted with ethyl acetate so as to have a solid content of 50% by weight (which is determined by drying the liquid for 30 minutes at 130° C.), was prepared.

(6) Preparation of Aqueous Phase Liquid

The following components were mixed.

| | |
|---|---|
| Ion-exchange water | 953 parts |
| 25% Aqueous dispersion of a styrene copolymer | 88 parts |

(styrene—methacrylic acid—butyl acrylate—sodium salt of sulfuric acid ester of ethylene oxide adduct of methacrylic acid)

| | |
|---|---|
| Aqueous solution of sodium salt of dodecyldiphenyletherdisulfonic acid (ELEMINOL MON-7 from Sanyo Chemical Industries Ltd., solid content of 48.5%) | 90 parts |
| Ethyl acetate | 113 parts |

Thus, an aqueous phase liquid 1, which is a milk white liquid, was prepared.

(7) Emulsification

Initially, 967 parts of the oil phase liquid 1, 6 parts of isophorone diamine, and the vinyl copolymer P1 were mixed for 1 minute using a TK HOMOMIXER mixer from Tokushu Kika Kogyo Co., Ltd. rotated at 5,000 rpm. In this regard, the added amount of the vinyl copolymer P1 was such that the content of the vinyl copolymer P1 in the resultant toner is 10% by weight.

Next, 137 parts of the prepolymer 1 prepared above was added thereto, and the mixture was mixed for 1 minute using the TK HOMOMIXER mixer rotated at 5,000 rpm.

Further, 1200 parts of the aqueous phase liquid prepared above was added thereto, and the mixture was agitated for 20 minutes using the TK HOMOMIXER mixer whose revolution was adjusted in a range of from 8,000 rpm to 13,000 rpm. Thus, an emulsion slurry 1 was prepared.

(8) Solvent Removal

The above-prepared emulsion slurry 1 was fed into a container equipped with an agitator and a thermometer to be subjected to a solvent removal treatment for 8 hours at 30° C. Thus, a dispersion slurry 1 was prepared.

(9) Washing

One hundred (100) parts of the dispersion slurry 1 was filtered under a reduced pressure.

The wet cake was mixed with 100 parts of ion-exchange water and the mixture was agitated for 10 minutes with a TK HOMOMIXER mixer at a revolution of 12,000 rpm, followed by filtration. Thus, a wet cake (a) was prepared.

The thus prepared wet cake (a) was mixed with 900 parts of ion-exchange water and the mixture was agitated for 30 minutes with the TK HOMOMIXER mixer at a revolution of 12,000 rpm while applying ultrasonic vibration thereto, followed by filtration. This operation was repeated until the resultant slurry had an electroconductivity of not greater than 10 μS/cm.

The slurry was mixed with a 10% hydrochloric acid so that the pH of the mixture became 4, and the mixture was agitated for 30 minutes by a three-one motor, followed by filtering to prepare a wet cake (b).

The thus prepared wet cake (b) was mixed with 100 parts of ion-exchange water and the mixture was agitated for 10 minutes with the TK HOMOMIXER mixer, followed by filtration. This operation was repeated until the resultant slurry had an electroconductivity of not greater than 10 μS/cm. Thus, a filtered cake 1 was prepared.

(10) Drying

The filtered cake 1 was dried for 48 hours at 45° C. using a circulation air drier, followed by screening with a sieve having openings of 75 μm.

Thus, toner particles 1 (mother toner 1) were prepared.

It was confirmed that the toner particles 1 have an ATR value of 0.028, a volume average particle diameter of 5.8 μm, a number average particle diameter of 5.2 μm, and average circularity of 0.973. In this regard, the ATR value means a ratio B/A of the peak B to the peak A in the infrared absorption spectrum of the toner particles 1 obtained by the FT-IR ATR method.

(11) Preparation of Toner 1

One hundred (100) parts of the toner particles 1 were mixed with 0.5 parts of a hydrophobized silica and 0.5 parts of a hydrophobized titanium oxide by a HENSCEL MIXER mixer to prepare a toner 1.

This toner was used for evaluating the solid image reproducibility.

4. Static Friction Coefficient

The static friction coefficient of the surface of the developing roller was measured by the method described in paragraph [0082] of JP-2003-029527-A under an environmental condition of 23° C. and 45% RH. The method is the following.

Specifically, a paper sheet (TYPE 6200 from Ricoh Co., Ltd.) is set on the developing roller which is fixedly set laterally, and one end of the paper sheet is connected with a weight of 100 g and the other end is connected with a tension gage so that the portion of the paper sheet between the weight and the developing roller forms a right angle with the portion of the paper sheet between the developing roller and the tension gage. The tension gage is pulled horizontally to measure the maximum static friction coefficient, which is defined as the friction coefficient when the paper sheet starts to move at a speed of 1 mm/sec.

5. Abrasion of Edge Portion of Developing Roller

A running test in which 2,000 copies of a chart with an image area proportion of 1% are produced under a high temperature and high humidity condition (27° C. and 80% RH) was performed using the image forming apparatus IPSIO SP C310 from Ricoh Co., Ltd. After the running test, the depth of the abraded portion of the edge portion (on the driving side) of the developing roller was measured using a projector PJ-H30 from Mitsutoyo Corporation.

The abrasion property of the developing roller was graded as follows.

◎: The depth of the abraded portion is less than 100 μm. (Excellent)

○: The depth of the abraded portion is not less than 100 μm and less than 250 μm. (Good)

x: The depth of the abraded portion is not less than 250 μm. (Unacceptable)

The evaluation results are shown in Table 2 below.

TABLE 2

| | Water contact angle (°) | Si peak intensity | Solid image reproducibility | Static friction coefficient | Abrasion of edge portion |
|---|---|---|---|---|---|
| Ex. 1 | 140.5 | ◎ | ○ | 0.11 | ◎ |
| Ex. 2 | 145.4 | ◎ | ◎ | 0.12 | ◎ |
| Ex. 3 | 151.3 | ◎ | ◎ | 0.15 | ◎ |
| Ex. 4 | 154.9 | ◎ | ◎ | 0.10 | ◎ |
| Ex. 5 | 136.8 | ○ | ○ | 0.11 | ◎ |
| Ex. 6 | 141.3 | ○ | ◎ | 0.13 | ◎ |
| Ex. 7 | 137.2 | ○ | ○ | 0.14 | ◎ |
| Ex. 8 | 135.0 | ○ | ○ | 0.15 | ◎ |
| Ex. 9 | 135.9 | ○ | ○ | 0.14 | ◎ |
| Comp. Ex. 1 | 100.7 | X | X | 0.17 | ○ |
| Comp. Ex. 2 | 82.1 | Δ | X | 0.12 | ○ |
| Comp. Ex. 3 | 95.3 | Δ | X | 0.13 | ○ |
| Comp. Ex. 4 | 130.1 | X | X | 0.27 | X |

It is clear from Table 2 that the developing rollers of Examples 1-9 have a good combination of resistance to toner filming, solid image reproducibility, and resistance to abrasion. In contrast, at least one of the properties of the developing rollers of Comparative Examples 1-4 is of a bad level.

As mentioned above, the developing roller which hardly causes the toner filming problem and the roller abrasion problem mentioned above even when low temperature fixable toner is used and high speed development is performed over a long period of time.

Additional modifications and variations of the present invention are possible in light of the above teachings. It is therefore to be understood that within the scope of the appended claims the invention may be practiced other than as specifically described herein.

What is claimed is:

1. A developing roller comprising:

a cylindrical electroconductive substrate;

an electroconductive elastic layer located on a peripheral surface of the cylindrical electroconductive substrate; and a toner bearing layer located on a peripheral surface of the electroconductive elastic layer, wherein the toner bearing layer includes a polyurethane resin which is a reaction product of at least an isocyanate compound having an isocyanurate structure and a polyol at a NCO/OH molar ratio of from 90 to 110, and the toner bearing layer has a water contact angle of from 135° to 155°, and a static friction coefficient of from 0.10 to 0.15.

2. The developing roller according to claim 1, wherein the polyurethane resin is a reaction product of a polyisocyanurate prepolymer having an isocyanurate structure, a polyol, and at least one of a compound having a fluorine-containing group or a silicone-based functional group, and a compound having an alkyl group in a side chain thereof.

3. The developing roller according to claim 2, wherein the compound having a fluorine-containing group or a silicone-based functional group is a compound selected from fluoroethylene vinyl ether copolymers, carboxylic acids having a perfluoroalkyl group, alcohols having a perfluoroalkyl group, amines having a perfluoroalkyl group, and silane coupling agents having a perfluoroalkyl group.

4. The developing roller according to claim 2, wherein the compound having an alkyl group in a side chain thereof is a compound selected from alcohols having an alkyl group, and amines having an alkyl group.

5. The developing roller according to claim 2, wherein the polyisocyanate prepolymer having an isocyanurate structure includes at least one of isocyanurate of hexamethylene diisocyanate and isocyanurate of tolylene diisocyanate.

6. The developing roller according to claim 1, wherein the polyurethane resin is a reaction product of a poly isocyanate prepolymer having an isocyanurate structure, and a polyol having at least one of a fluorine-containing group, a silicone-based functional group, and an alkyl group, which is included in a side chain thereof.

7. A developing device comprising:

the developing roller according to claim 1 to bear a developer including a toner on a surface thereof to supply the developer to a latent image bearing member;

a developer container to contain the developer;

a developer supplying member to supply the developer in the developer container to a surface of the developing roller; and a developer regulating member to form a layer of the developer on the developing roller.

8. A process cartridge comprising:

a latent image bearing member to bear an electrostatic latent image on a surface thereof; and the developing device according to claim 7 to develop the electrostatic latent image on the surface of the latent image bearing member with a developer including a toner to form a toner image on the surface of the latent image bearing member, wherein the latent image bearing member and the developing device are integrated as a unit.

9. An image forming apparatus comprising:

a latent image bearing member to bear an electrostatic latent image on a surface thereof;

a charger to charge the surface of the latent image bearing member;

an irradiator to irradiate the charged surface of the latent image bearing member with light based on image data to form the electrostatic latent image on the surface of the latent image bearing member;

the developing device according to claim 7 to develop the electrostatic latent mage with a developer including a toner to form a toner image on the surface of the latent image bearing member;

a transferring device to transfer the toner image onto a recording medium; and a fixing device to fix the toner image to the recording medium.

10. An image forming method comprising:

charging a surface of a latent image bearing member;

irradiating the charged surface of the latent image bearing member with light based on image data to form an electrostatic latent image on the surface of the latent image bearing member;

forming a developer layer with a predetermined thickness on the developing roller according to claim 1;

developing the electrostatic latent image with the developer layer on the developing roller to form a toner image on the surface of the latent image bearing member;

transferring the toner image onto a recording medium; and fixing the toner image to the recording medium.

* * * * *